US010897977B2

(12) United States Patent
Barker

(10) Patent No.: US 10,897,977 B2
(45) Date of Patent: Jan. 26, 2021

(54) LIP BALM APPLICATOR ASSEMBLY

(71) Applicant: Jacqueline Barker, New Kensington, PA (US)

(72) Inventor: Jacqueline Barker, New Kensington, PA (US)

( * ) Notice: Subject to any disclaimer, the term of this patent is extended or adjusted under 35 U.S.C. 154(b) by 1 day.

(21) Appl. No.: 16/267,544

(22) Filed: Feb. 5, 2019

(65) Prior Publication Data

US 2020/0245743 A1 Aug. 6, 2020

(51) Int. Cl.
*A46B 17/08* (2006.01)
*A45D 40/26* (2006.01)
*A45D 40/00* (2006.01)

(52) U.S. Cl.
CPC ..... *A45D 40/262* (2013.01); *A45D 40/0068* (2013.01)

(58) Field of Classification Search
CPC ..... A45D 33/26; A45D 33/28; A45D 34/06; A45D 40/0068
USPC ..... 401/123–125; 132/297
See application file for complete search history.

(56) References Cited

U.S. PATENT DOCUMENTS

| | | | | |
|---|---|---|---|---|
| 4,228,925 | A * | 10/1980 | Mendelovich | A47K 1/09 222/103 |
| 4,428,388 | A | 1/1984 | Cassai | |
| 6,298,863 | B1 * | 10/2001 | Byun | A45D 40/22 132/294 |
| 7,083,354 | B2 * | 8/2006 | Byun | A45D 33/006 132/294 |
| 7,249,906 | B2 * | 7/2007 | Kessler | A45D 40/0075 215/390 |
| D733,967 | S | 7/2015 | Schlatter | |
| 2004/0190974 | A1 | 9/2004 | Cantone | |
| 2006/0207627 | A1 | 9/2006 | Thorpe | |
| 2011/0071792 | A1 | 3/2011 | Miner | |

* cited by examiner

*Primary Examiner* — Jennifer C Chiang

(57) ABSTRACT

A lip balm applicator assembly for applying lip balm without touching the lip balm includes a canister that contains a viscous lip balm. The canister has a storage compartment integrated therein and the storage compartment is fluidly discrete from an interior of the canister. A lid is removably coupled to the canister for closing the canister. An applicator is slidably positioned in the storage compartment for storage. The applicator is dipped into the viscous lip balm in the canister to apply the viscous lip balm to lips without requiring the viscous lip balm in the container to be touched. In this way the applicator reduces transfer of bacteria to the viscous lip balm in the container.

7 Claims, 3 Drawing Sheets

LIP BALM APPLICATOR ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to applicator devices and more particularly pertains to a new applicator device for applying lip balm without touching the lip balm.

BRIEF SUMMARY OF THE INVENTION

An embodiment of the disclosure meets the needs presented above by generally comprising a canister that contains a viscous lip balm. The canister has a storage compartment integrated therein and the storage compartment is fluidly discrete from an interior of the canister. A lid is removably coupled to the canister for closing the canister. An applicator is slidably positioned in the storage compartment for storage. The applicator is dipped into the viscous lip balm in the canister to apply the viscous lip balm to lips without requiring the viscous lip balm in the container to be touched. In this way the applicator reduces transfer of bacteria to the viscous lip balm in the container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
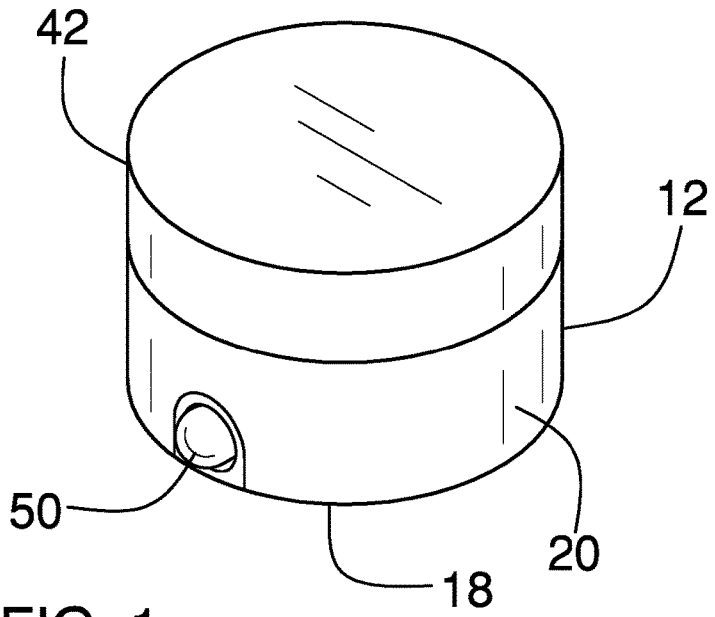
FIG. 1 is a top perspective view of a lip balm applicator assembly according to an embodiment of the disclosure.
Figure 2:
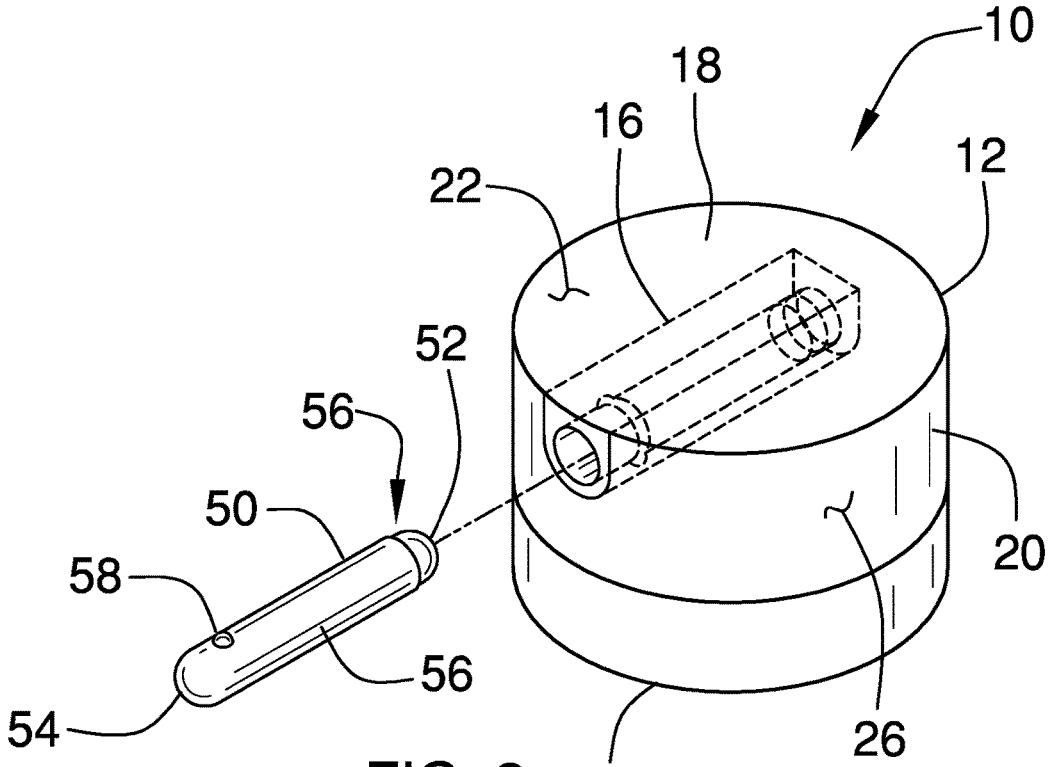
FIG. 2 is an exploded phantom view of an embodiment of the disclosure.
Figure 3:
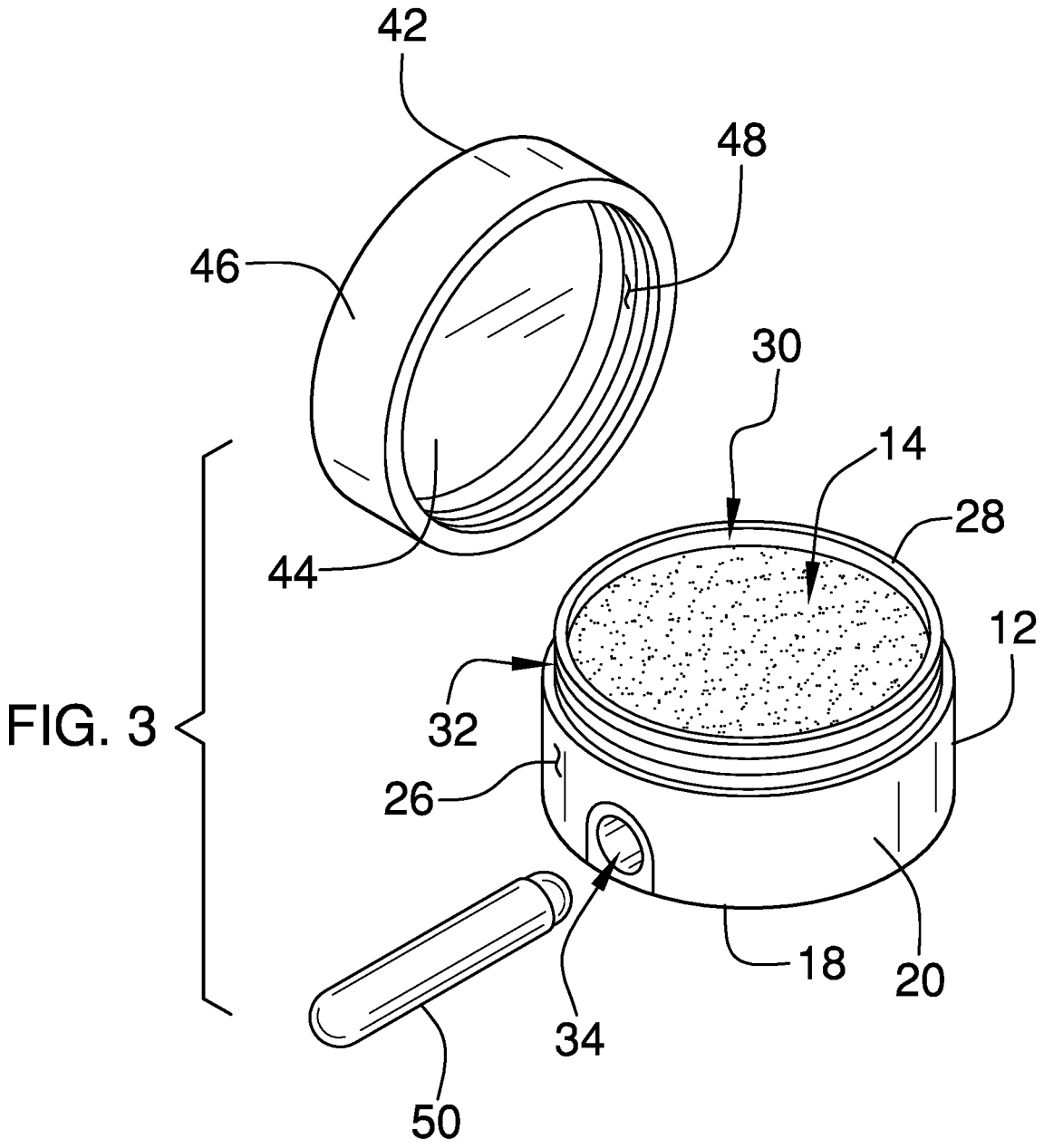
FIG. 3 is an exploded perspective view of an embodiment of the disclosure.
Figure 4:
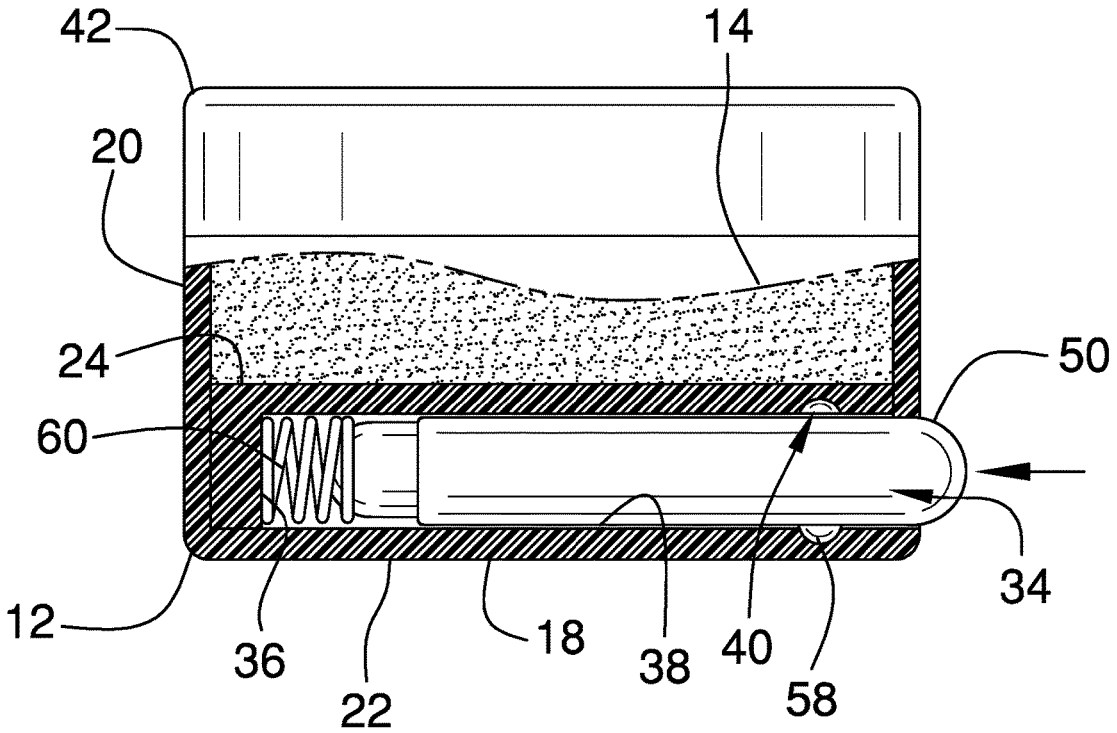
FIG. 4 is a right side cut-way view of an embodiment of the disclosure showing an applicator being inserted into a well.
Figure 5:
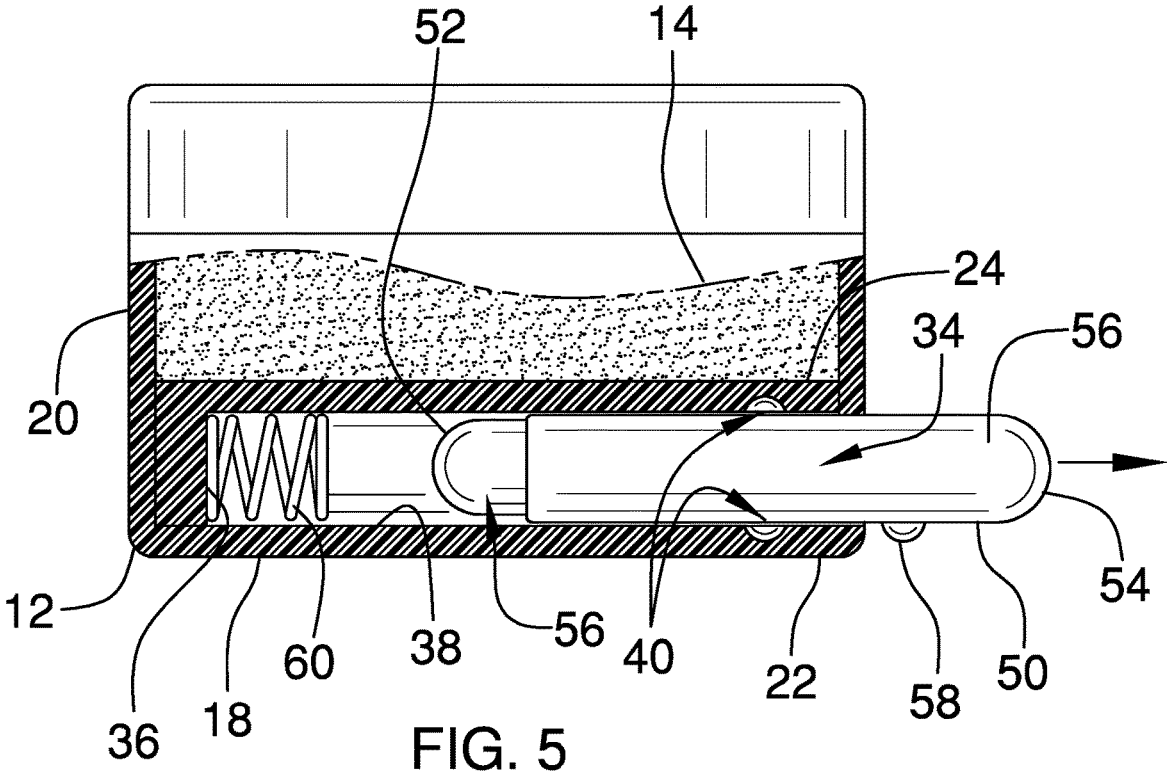
FIG. 5 is a right side cut-away view of an embodiment of the disclosure showing an applicator being removed from a well.

With reference now to the drawings, and in particular to FIGS. 1 through 5 thereof, a new applicator device embodying the principles and concepts of an embodiment of the disclosure and generally designated by the reference numeral 10 will be described.

As best illustrated in FIGS. 1 through 5, the lip balm applicator assembly 10 generally comprises a canister 12 that has a viscous lip balm 14 contained therein. The canister 12 has a storage compartment 16 that is integrated therein and the storage compartment 16 is fluidly discrete from an interior of the canister 12. Thus, the viscous lip balm 14 does not enter the storage compartment 16. The canister 12 has a lower wall 18 and a perimeter wall 20 extending upwardly therefrom, and the lower wall 18 has a bottom surface 22 and a top surface 24. The perimeter wall 20 has an outer surface 26 and a distal edge 28 with respect to the lower wall 18 defining an opening 30 to access the interior of the canister 12.

The outer surface 26 has an inset portion 32 extending downwardly from the distal edge 28 and the inset portion 32 is threaded. The perimeter wall 20 has a well 34 extending inwardly therein to define the storage compartment 16. The well 34 is oriented to extend between the top 24 and bottom 22 surfaces of the lower wall 18. Additionally, the well 34 has a lower bounding surface 36 and a perimeter bounding surface 38, and the perimeter bounding surface 38 has a plurality of divots 40 therein. The divots 40 are positioned closer to said perimeter wall 20 of the canister 12 than the lower bounding surface 36 of the well 34.

A lid 42 is provided and the lid 42 is removably coupled to the canister 12 for closing the canister 12. The lid 42 has a top wall 44 and a peripheral wall 46 extending downwardly therefrom, the peripheral wall 46 is continuously arcuate such that the lid 42 has a circular shape and the peripheral wall 46 has an inside surface 48. The inside surface 48 threadably engages the inset portion 32 of the outer surface 26 of the perimeter wall 20 when the lid 42 is removably coupled to the canister 12 having the top wall 44 resting on the distal edge 28 of the perimeter wall 20.

An applicator 50 is provided and the applicator 50 is slidably positioned in the storage compartment 16 for storage. The applicator 50 is dipped into the viscous lip balm 14 in the canister 12 for applying the viscous lip balm 14 to lips without requiring the viscous lip balm 14 in the container to be touched. In this way the applicator 50 reduces transfer of bacteria to the viscous lip balm 14 in the container from a person's fingers or the like. The applicator 50 has a first end 52, a second end 54 and an outside surface 56 extending therebetween. Moreover, the applicator 50 is elongated between the first 52 and second 54 ends, and each of the first 52 and second 54 ends is rounded. The outside surface 56 has an inset portion 56 extending around the first end 52 toward the second end 54 such that the first end 52 has a diameter that is less than a diameter of the second end 54.

A ball 58 is movably coupled to the outside surface 56 of the applicator 50. The ball 58 is biased to extend outwardly from the outside surface 56 and the ball 58 is urgeable inwardly on the outside surface 56. Moreover, the ball 58 engages a respective one of the divots 40 when the applicator 50 is slid 42 into the well 34. In this way the applicator 50 is removably retained in the well 34. A spring 60 is positioned in the well 34 and the spring 60 is compressed between the lower bounding surface 36 of the well 34 and the first end 52 of the applicator 50 when the applicator 50 is inserted into the well 34. Thus, the spring 60 biases the applicator 50 outwardly from the well 34 to assist removing the applicator 50 from the well 34. The second end 54 of the applicator 50 extends outwardly from the well 34 when the applicator 50 is fully inserted into the well 34. Thus, the second end 54 of the applicator 50 can be gripped for removing the applicator 50 from the well 34.

In use, the lid 42 is removed from the canister 12 and the applicator 50 is removed from the well 34. The first end 52 of the applicator 50 is dipped into the viscous lip balm 14 and the first end 52 of the applicator 50 is rubbed on the user's lips to apply the viscous lip balm 14 to the user's lips. In this way the viscous lip balm 14 can be applied without ever being touched by a person's fingers, thereby inhibiting transfer of bacteria between users. Additionally, the first end 52 of the applicator 50 is concealed with the well 34 when the applicator 50 is positioned in the well 34. Thus, the first end 52 is inhibited from being exposed to bacteria when the applicator 50 is not being used.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lip balm applicator assembly being configured to store and apply a lip balm without being touched by fingers, said assembly comprising:

a canister having a viscous lip balm being contained therein, said canister having a storage compartment being integrated therein, said storage compartment being fluidly discrete from an interior of said canister, said storage compartment having a pair of substantially planar outer lateral sides and an arched surface extending between said outer lateral sides wherein said storage compartment is elongated and said interior space extends over the arched surface and down around the outer lateral sides of the storage compartment;

a lid being removably coupled to said canister for closing said canister; and an applicator being slidably positioned in said storage compartment for storage, said applicator being dipped into the viscous lip balm in said canister wherein said applicator is configured to apply the viscous lip balm to lips without requiring the viscous lip balm in said container to be touched thereby reducing transfer of bacteria to the viscous lip balm in said container.

2. The assembly according to claim 1, wherein:

said canister has a lower wall and a perimeter wall extending upwardly therefrom, said lower wall having a bottom surface and a top surface, said perimeter wall having an outer surface and a distal edge with respect to said bottom wall defining an opening to access said interior of said canister;

said outer surface having an inset portion extending downwardly from said distal edge, said inset portion being threaded; and said perimeter wall having a well extending inwardly therein to define said storage compartment, said well being oriented to extend between said top and bottom surfaces of said lower wall, said well having a lower bounding surface and a perimeter bounding surface, said perimeter bounding surface having a plurality of divots therein.

3. The assembly according to claim 2, wherein said lid has a top wall and a peripheral wall extending downwardly therefrom, said peripheral wall being continuously arcuate such that said lid has a circular shape, said peripheral wall having an inside surface, said inside surface threadably engaging said inset portion of said outer surface of said perimeter wall when said lid is removably coupled to said canister having said top wall resting on said distal edge of said perimeter wall.

4. The assembly according to claim 2, wherein said applicator has a first end, a second end and an outside surface extending therebetween, said applicator being elongated between said first and second ends, each of said first and second ends being rounded, said outside surface having an inset portion extending around said first end toward said second end such that said first end has a diameter being less than a diameter of said second end.

5. The assembly according to claim 4, further comprising a ball being movably coupled to said outside surface of said applicator, said ball being biased to extend outwardly from said outside surface, said ball being urgeable inwardly on said outside surface, said ball engaging a respective one of said divots when said applicator is slid into said well thereby removably retaining said applicator in said well.

6. The assembly according to claim 5, further comprising a spring being positioned in said well, said spring being compressed between said lower bounding surface of said well and said first end of said applicator when said applicator is inserted into said well, said spring biasing said applicator outwardly from said well to assist removing said applicator from said well.

7. A lip balm applicator assembly being configured to store and apply a lip balm without being touched by fingers, said assembly comprising:

a canister having a viscous lip balm being contained therein, said canister having a storage compartment being integrated therein, said storage compartment being fluidly discrete from an interior of said canister, said storage compartment having a pair of substantially planar outer lateral sides and an arched surface extending between said outer lateral sides wherein said storage compartment is elongated and said interior space extends over the arched surface and down around the outer lateral sides of the storage compartment, said canister having a lower wall and a perimeter wall extending upwardly therefrom, said lower wall having a bottom surface and a top surface, said perimeter wall having an outer surface and a distal edge with respect to said bottom wall defining an opening to access said interior of said canister, said outer surface having an inset portion extending downwardly from said distal edge, said inset portion being threaded, said perimeter wall having a well extending inwardly therein to define said storage compartment, said well being oriented to extend between said top and bottom surfaces of said lower wall, said well having a lower bounding surface and a perimeter bounding surface, said perimeter bounding surface having a plurality of divots therein;

a lid being removably coupled to said canister for closing said canister, said lid having a top wall and a peripheral wall extending downwardly therefrom, said peripheral wall being continuously arcuate such that said lid has a circular shape, said peripheral wall having an inside surface, said inside surface threadably engaging said inset portion of said outer surface of said perimeter wall when said lid is removably coupled to said canister having said top wall resting on said distal edge of said perimeter wall;

an applicator being slidably positioned in said storage compartment for storage, said applicator being dipped into the viscous lip balm in said canister wherein said applicator is configured to apply the viscous lip balm to lips without requiring the viscous lip balm in said container to be touched thereby reducing transfer of bacteria to the viscous lip balm in said container, said applicator having a first end, a second end and an outside surface extending therebetween, said applicator being elongated between said first and second ends, each of said first and second ends being rounded, said outside surface having an inset portion extending around said first end toward said second end such that said first end has a diameter being less than a diameter of said second end;

a ball being movably coupled to said outside surface of said applicator, said ball being biased to extend outwardly from said outside surface, said ball being urgeable inwardly on said outside surface, said ball engaging a respective one of said divots when said applicator is slid into said well thereby removably retaining said applicator in said well; and a spring being positioned in said well, said spring being compressed between said lower bounding surface of said well and said first end of said applicator when said applicator is inserted into said well, said spring biasing said applicator outwardly from said well to assist removing said applicator from said well.

* * * * *